US006212889B1

(12) United States Patent
Martin

(10) Patent No.: US 6,212,889 B1
(45) Date of Patent: Apr. 10, 2001

(54) DIRECT ACTING ROTARY ACTUATOR FOR A TURBOCHARGER VARIABLE NOZZLE TURBINE

(75) Inventor: Steven P. Martin, West Covina, CA (US)

(73) Assignee: AlliedSignal Inc., Morris Township, NJ (US)

( * ) Notice: Subject to any disclaimer, the term of this patent is extended or adjusted under 35 U.S.C. 154(b) by 0 days.

(21) Appl. No.: 09/404,383

(22) Filed: Sep. 23, 1999

Related U.S. Application Data

(60) Provisional application No. 60/102,699, filed on Oct. 1, 1998.

(51) Int. Cl.[7] ..... F02D 23/00

(52) U.S. Cl. ..... 60/602; 92/136; 92/33

(58) Field of Search ..... 60/602; 74/424.8 R; 92/136, 33

(56) References Cited

U.S. PATENT DOCUMENTS

| | | | | |
|---|---|---|---|---|
| 3,090,244 | * | 5/1963 | Davis | 74/424.8 R |
| 4,313,367 | | 2/1982 | Weyer . | |
| 4,508,016 | * | 4/1985 | Weyer | 92/33 |
| 4,804,316 | | 2/1989 | Fluery . | |
| 5,447,095 | * | 9/1995 | Weyer | 92/33 |
| 5,487,273 | * | 1/1996 | Elpern et al. | 60/602 |

FOREIGN PATENT DOCUMENTS

| | | | | |
|---|---|---|---|---|
| 4111340 A1 | | 10/1992 | (DE) . | |
| 297 16 199 U1 | | 11/1997 | (DE) . | |
| 2033007A | * | 5/1980 | (GB) | 60/602 |
| 2164099A | | 3/1986 | (GB) . | |

* cited by examiner

*Primary Examiner*—Thomas Denion
*Assistant Examiner*—Thai-Ba Trieu
(74) *Attorney, Agent, or Firm*—Felix L. Fischer; Grant T. Langton

(57) ABSTRACT

A axial to rotational motion actuator employs two sets of engaged helical splines on rotational collars provides a large degree of rotary actuation from a relatively short axial stroke to provides efficient non-binding and reduced effort actuator operation. This improved actuation movement makes the actuator assembly both more responsive to a hydraulic activating means, i.e., oil pressure, and enables packaging the actuator assembly in a compact size to optimize available space around a turbocharger and inside of an engine compartment.

1 Claim, 4 Drawing Sheets

DIRECT ACTING ROTARY ACTUATOR FOR A TURBOCHARGER VARIABLE NOZZLE TURBINE

CROSS REFERENCE TO RELATED APPLICATIONS

This application claims the priority of copending application Ser. No. 60/102,699 filed on Oct. 1, 1998 having the same title as the present application.

FIELD OF THE INVENTION

This invention relates generally to the field of turbochargers and, more particularly, to an improved pneumatic actuator for use with a turbocharger variable nozzle turbine.

BACKGROUND OF THE INVENTION

Turbochargers for gasoline and diesel internal combustion engines are known devices used in the art for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor impeller mounted onto an opposite end of the shaft. Thus, rotary action of the turbine also causes the air compressor impeller to spin within a compressor housing of the turbocharger that is separate from the exhaust housing. The spinning action of the air compressor impeller causes intake air to enter the compressor housing and be pressurized or boosted a desired amount before it is mixed with fuel and combusted within the engine combustion chamber.

The amount by which the intake air is boosted or pressurized is controlled by regulating the amount of exhaust gas that is passed through the turbine housing by a wastegate, and/or by selectively opening or closing an exhaust gas channel or passage to the turbine running through the turbine housing, and/or by adjusting the position of one or more vanes within the turbine housing to vary the gas flow velocity of exhaust gas to the turbine. For example, the use of adjustable vanes within a turbine housing can be used as one way of reducing turbo lag, i.e., the lag time between the time that the vehicle is accelerated from idle and sufficient pressure is developed by the turbocharger compressor to effect an appreciable increase in engine power, by reducing the flow area within the turbine housing to provide the necessary power to quickly accelerate the turbine wheel. As the volumetric flow rate of exhaust gas increases with increasing engine RPM, the vanes are adjusted to increase the flow area within the turbine housing to enable the exhaust gas to generate the appropriate power to compress the necessary quantity of inlet air.

Turbochargers constructed having such an adjustable member within the turbine housing are referred to in industry as variable geometry turbines (VGTs). The movable member within such VGTs, in the form of vanes, nozzles or the like, is positioned in the turbine housing between an exhaust gas inlet or volute and the turbine. The movable member is activatable from outside of the turbine housing by suitable actuating mechanism to increase or decrease the exhaust gas flow within the turbine housing to regulate the air intake boost pressure as called for by the current engine operating conditions, as explained above.

VGTs known in the art can be actuated by using a pneumatic activating means, i.e., by using compressed air or the like or by hydraulic activating means, i.e., by using a pressurized fluid such as oil or the like. An example hydraulically activated actuator includes one comprising a combined piston and rack and pinion assembly. The piston in such actuator assembly is reciprocated within a cylinder by pressurized oil that is passed through a dedicated oil passage within the turbocharger. The oil is passed to the piston at a particular pressure using a valve. A rack and pinion assembly is used with the piston to convert reciprocating piston movement into rotary movement that ultimately actuates the movable member within the turbine, e.g., a VGT vane or nozzle.

A concern with the above-described design is that, due to spatial constraints, the use of a combined piston and rack and pinion assembly requires that the oil passage through the turbocharger be limited in diameter, thereby reducing the response of the actuator assembly to oil pressure. Additionally, the use of such combined piston and rack and pinion assembly requires additional space for proper assembly operation, thereby precluding packaging the assembly in a compact manner to both conserve space around the turbocharger unit and to minimize assembly exposure to radiant heat transfer caused by the intrusion of one or more component to the outline limits of the turbocharger.

It is, therefore, desired that an actuator assembly for a VGT be constructed in a manner that both improves actuator response to an activating means, and improves movable member response to the actuator, i.e., provides a more direct actuator movement to movable member movement. It is desired that such actuator assembly also be constructed having a compact size, when compared to conventional VGT actuators, to both increase available space around the turbocharger and minimize or eliminate exposure to undesirable heat effects.

SUMMARY OF THE INVENTION

A Turbocharger for internal combustion engines employing the present invention incorporates a turbocharger housing in which an actuator assembly is integrated for operating a movable member in the housing. The actuator assembly includes an actuator cylinder disposed within the housing and a main shaft positioned axially within the cylinder. the main shaft is rotatably mounted in the cylinder and has a set of helical splines disposed along an outside diameter surface section and the main shaft also has an end that extends through the cylinder that is connected to an actuating lever. A cylindrical collar is disposed concentrically around a section of the main shaft and is axially movable thereon. The collar includes an annular seal disposed along an inside diameter to form a leak-tight seal between the collar and the main shaft. The collar has a set of helical splines disposed along an outside diameter surface and a set of helical splines disposed along an inside diameter surface that complements and engages the set of helical splines on the main shaft. A sealing sleeve is attached to the collar adjacent an end of the collar with an outside diameter greater than the collar. The sealing sleeve includes an annular seal disposed along an outside diameter to form a leak-tight seal between the sealing sleeve and a cylinder wall surface. A stationary sleeve is disposed concentrically around the collar and fixedly mounted within the cylinder a sufficient distance from the sealing sleeve to permit a desired degree of axial sealing sleeve and collar displacement within the cylinder and the stationary sleeve has a set of helical splines disposed along an inside diameter that complements and engages the collar outside diameter helical splines to rotate the collar within the cylinder as the collar is displaced axially therethrough.

In operation, rotation of the collar and stationary sleeve causes the main shaft to be rotated within the cylinder by engagement between the set of helical splines disposed along the collar inside diameter and the set of helical gears disposed along the main shaft. The engaged sets of helical splines disposed along the collar inside diameter and along the main shaft are designed to rotate the main shaft in the same direction as the collar and to an extent greater than the collar. Hydraulic pressure activates the actuator assembly to provide axial and rotational motion.

BRIEF DESCRIPTION OF THE DRAWINGS

The details and features of the present invention will be more clearly understood with respect to the detailed description and the following drawings.

DETAILED DESCRIPTION OF THE INVENTION

A VGT, constructed according to principles of this invention, incorporates a direct acting rotary actuator assembly that is disposed integrally within the turbocharger housing and that is configured to effect operation of a movable member, e.g., a movable vane or nozzle element, within a turbine housing. The actuator assembly is designed to effect such operation using a compact rotary piston design that: (1) provides improved actuator response to an activating means, i.e., pneumatic or hydraulic means; (2) provides improved activator to movable member response; and (3) optimizes available space around the turbocharger and within an engine compartment.

Figure 1A:
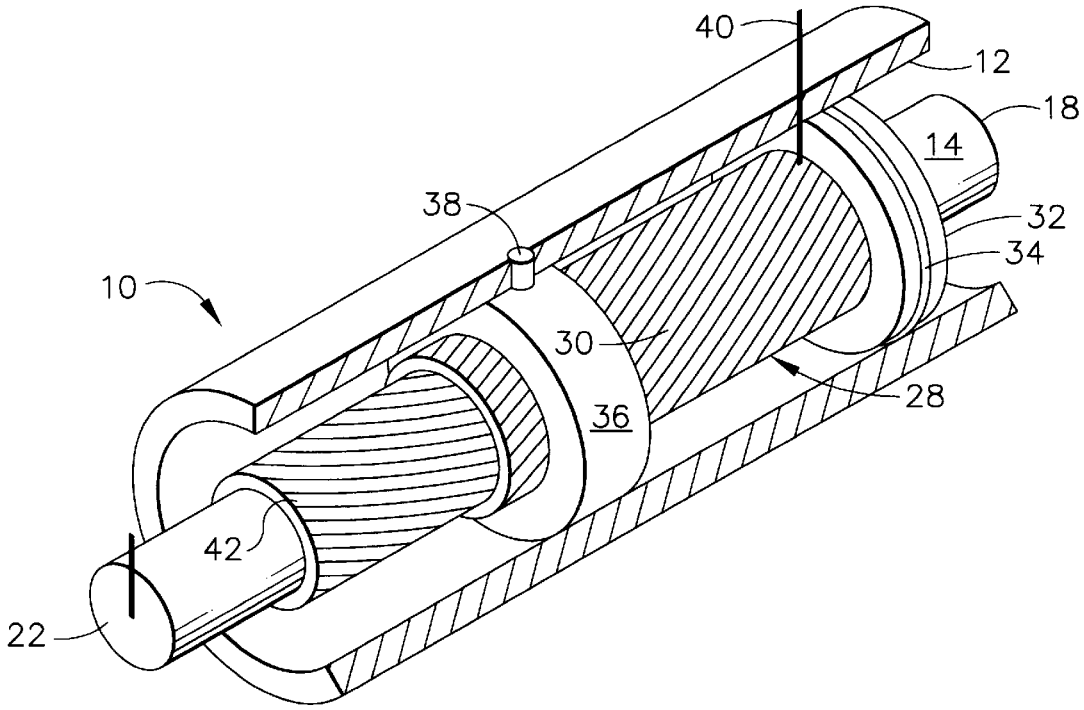
FIGS. 1A to 1D are schematic side elevation sections of a direct acting rotary actuator assembly, prepared according to principles of this invention, in different stages of operation.
Figure 1B:
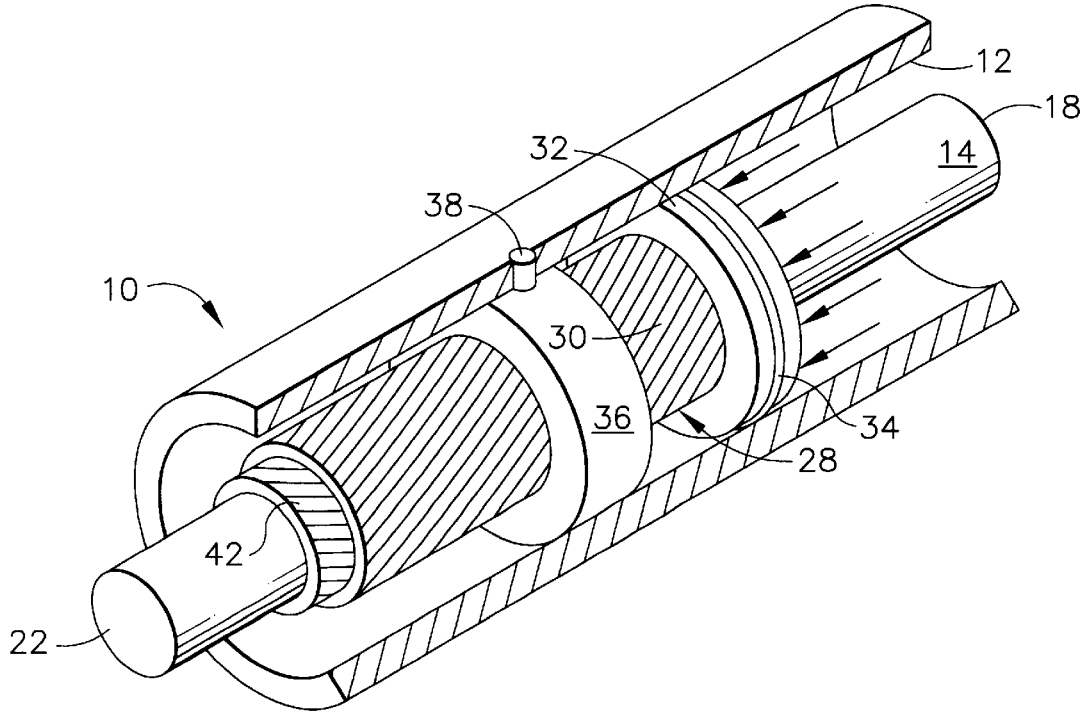
Figure 1C:
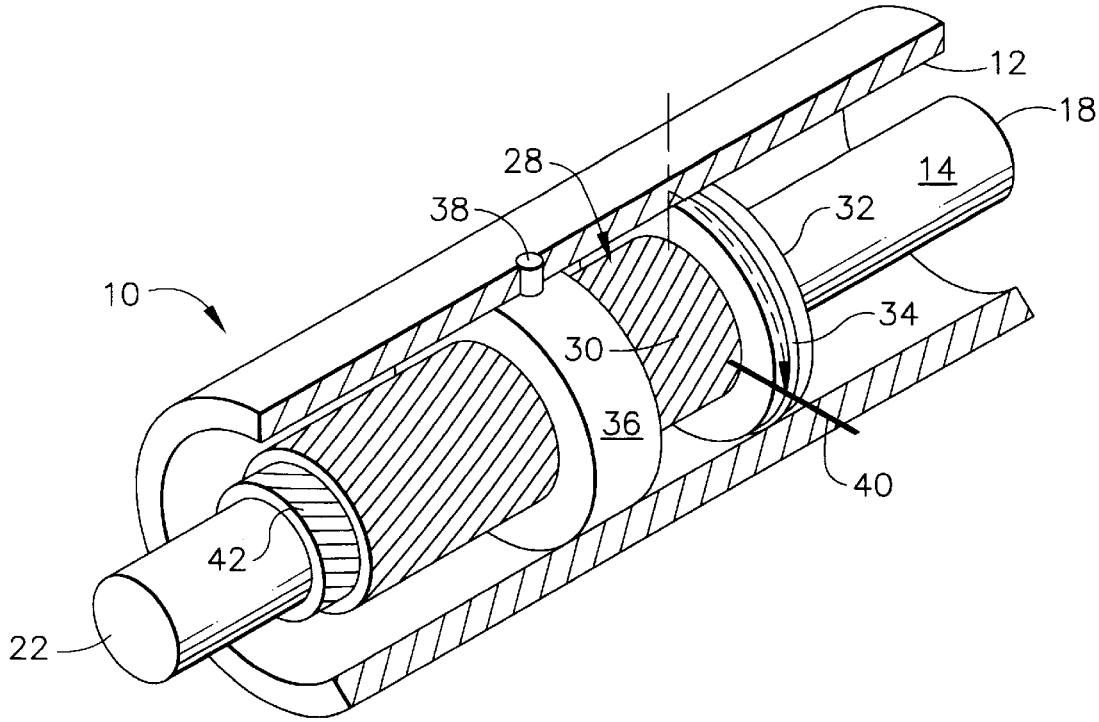
Figure 2:
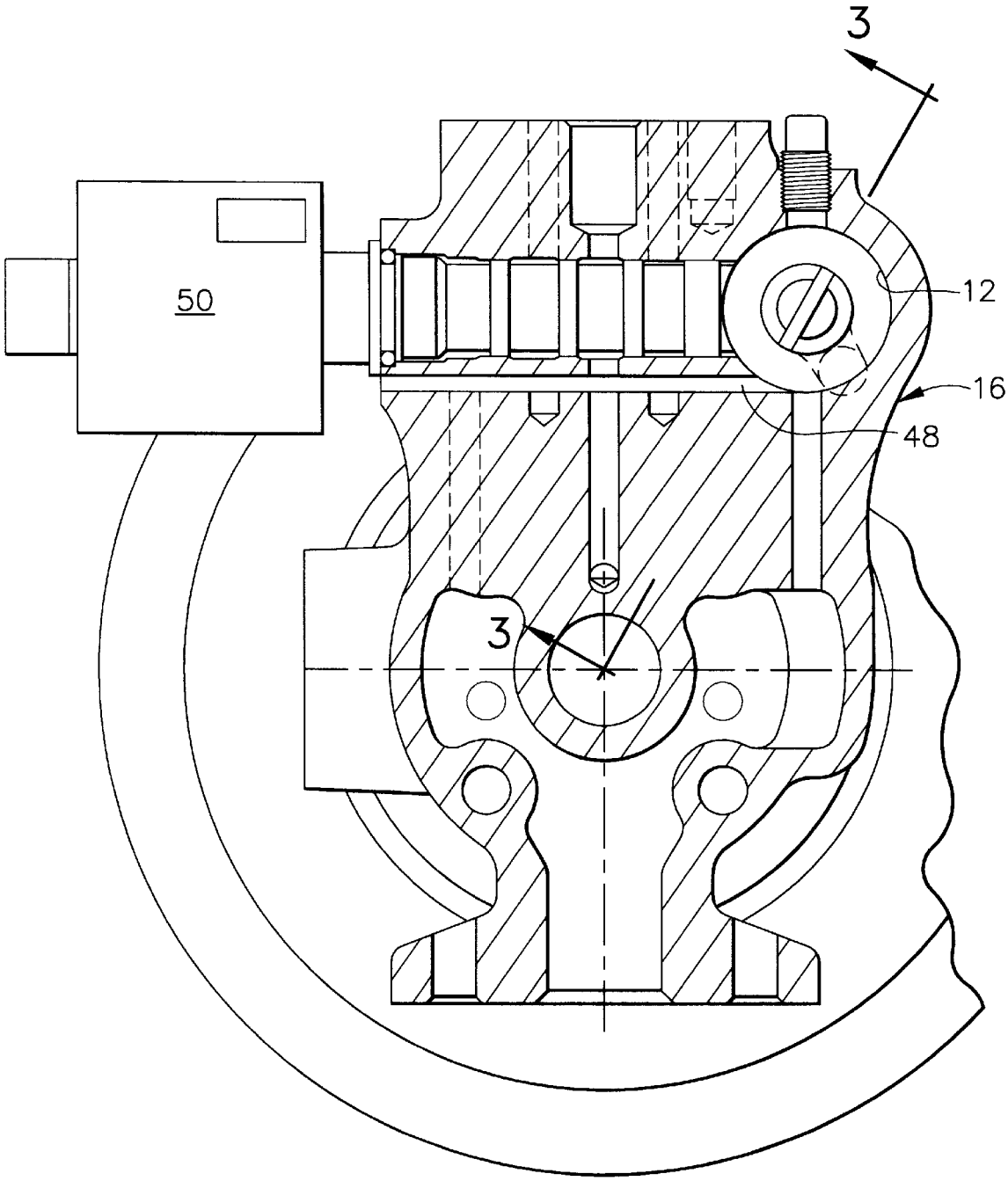
FIG. 2 is a cross-sectional end view of the direct acting rotary actuator assembly of FIGS. 1A to 1D attached to a turbocharger.
Figure 3:
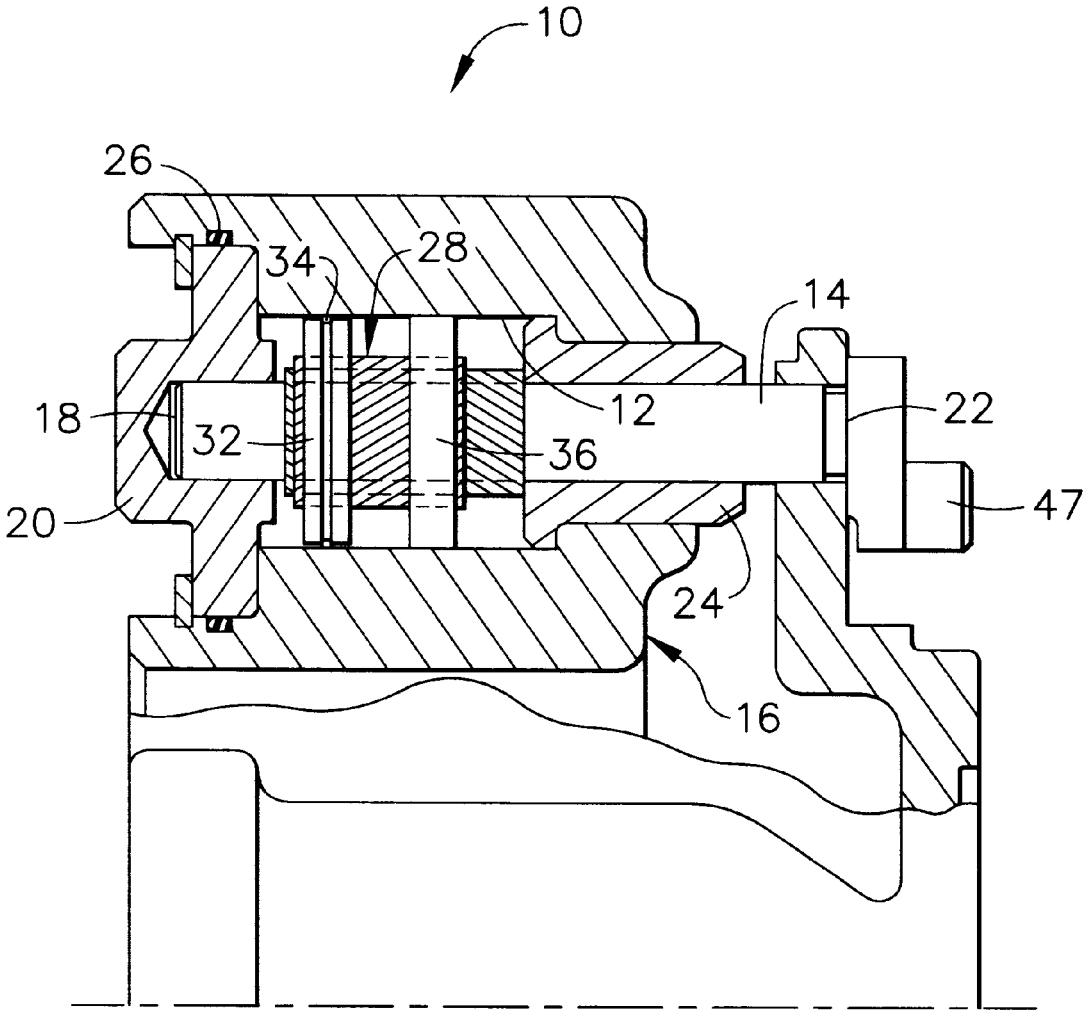
FIG. 3 is a cross-sectional side elevational view of section 3—3 in FIG. 2.

FIGS. 1A to 1D illustrate a direct acting rotary actuator assembly 10, according to principles of this invention, at different stages of operation. FIGS. 2 and 3 illustrate placement of the direct acting rotary actuator assembly 10 within a turbocharger housing as an integral member of the housing. Referring now to FIGS. 1A to 1D, the rotary actuator assembly 10 comprises a hollow cylinder 12 having a main shaft 14 extending axially therethrough. Referring to FIGS. 2 and 3, the cylinder 12 is integral with a turbocharger housing 16. In a preferred embodiment, the cylinder is integral with the shaft or center housing (not shown) of the turbocharger. Referring now to FIG. 3, the main shaft 14 includes a first end 18 that is rotatably disposed within a shaft bearing cap 20 mounted onto an end of the cylinder 12. A portion of the main shaft 14 adjacent an opposite second end 22 is positioned within a shaft bearing 24 fixedly mounted concentrically within the cylinder 12. The shaft bearing cap 20 includes an annular seal 26 extending circumferentially around an outside diameter and interposed between the bearing cap and cylinder to provide a leak-tight seal therebetween. Together, the shaft bearing cap 20 and shaft bearing 24 serve to center the main shaft 14 axially within the cylinder, and facilitate rotary movement of the main shaft during operation of the actuator assembly.

Referring back to FIGS. 1A to 1D, a cylindrical collar 28 is disposed within the cylinder, is positioned concentrically around the main shaft 14, and comprises a set of helical splines 30 disposed along a collar outside diameter surface. The collar 28 is axially and rotatably movable around the main shaft, and includes an annular seal (not shown) extending circumferentially along an inside diameter to form a leak-tight seal between the collar and the main shaft. The collar 28 extends along a partial axial length of the main shaft 14 as best seen in FIG. 3. A sealing sleeve 32 is disposed within the cylinder concentrically around an outside diameter of the collar 28. The sealing sleeve 32 is fixedly attached to the collar and includes an annular seal 34 extending circumferentially around an outside sleeve diameter and interposed between the sleeve and cylinder wall to provide a leak-tight seal therebetween. Such leak-tight seal is necessary to effect axially reciprocating sleeve and collar movement within the cylinder by directing a desired pneumatic or hydraulic force into the cylinder, as will be described in greater detail below.

A stationary sleeve 36 is positioned within the cylinder 12 concentrically around the outside diameter of the collar 28. The stationary sleeve 36 is fixedly attached to the cylinder 12 by a pin 38 that extends between the stationary sleeve 36 and the cylinder 12 to prevent its rotary or reciprocating movement within the cylinder. The stationary sleeve 36 includes a set of helical splines (not shown) along an inside diameter surface that are arranged to cooperate with the set of helical splines 30 along the collar 28. Engagement of the stationary sleeve helical splines and the collar helical splines 30 causes the collar 28 to rotate within the cylinder as the seal sleeve 32 and collar 28 are displaced axially within the cylinder and through the stationary sleeve 36. FIG. 1A includes a collar rotary locating point 40 at an initial reference point before pneumatic or hydraulic activating pressure is routed into the cylinder 12 between the shaft bearing cap 20 (see FIG. 3) and the sealing sleeve 32. As shown in FIG. 1B, the activating pressure routed into the cylinder causes the sealing sleeve 32 and collar 28 to move axially within the cylinder towards the stationary sleeve 36. As shown in FIG. 1C, as the collar 28 is moved axially within the cylinder and through the stationary sleeve 36 the engaging helical splines of the collar and stationary sleeve cause the collar and sealing sleeve to be rotated a desired degree within the cylinder, as indicated by the new angular position of the collar rotary locating point 40. It is understood that the amount by which the collar rotates within the cylinder per axial collar movement will vary depending on the particular application and operational constraints, e.g., available space. In an example embodiment, complete axial displacement of the collar and sealing sleeve within the cylinder provides a collar rotary displacement of approximately 90 degrees.

To effect rotation of the main shaft 12, by rotation of the collar, an outside diameter surface of the main shaft is configured having a set of helical splines 42 disposed therealong. Additionally, the collar 28 includes a complementary set of helical splines (not shown) disposed along an inside diameter surface. The main shaft helical splines 42 and the collar inside diameter splines are configured to amplify the amount by which the collar 28 is rotated within the cylinder by pneumatic or hydraulic activating force as described above. As illustrated in FIGS. 1A to 1D, as the collar 28 is moved axially along the main shaft 14 the main shaft helical splines 42 and the collar inside diameter splines engage and cooperate with each other and cause the main shaft to be rotated to an extent that is greater than that achieved by the collar alone.

Figure 1D:
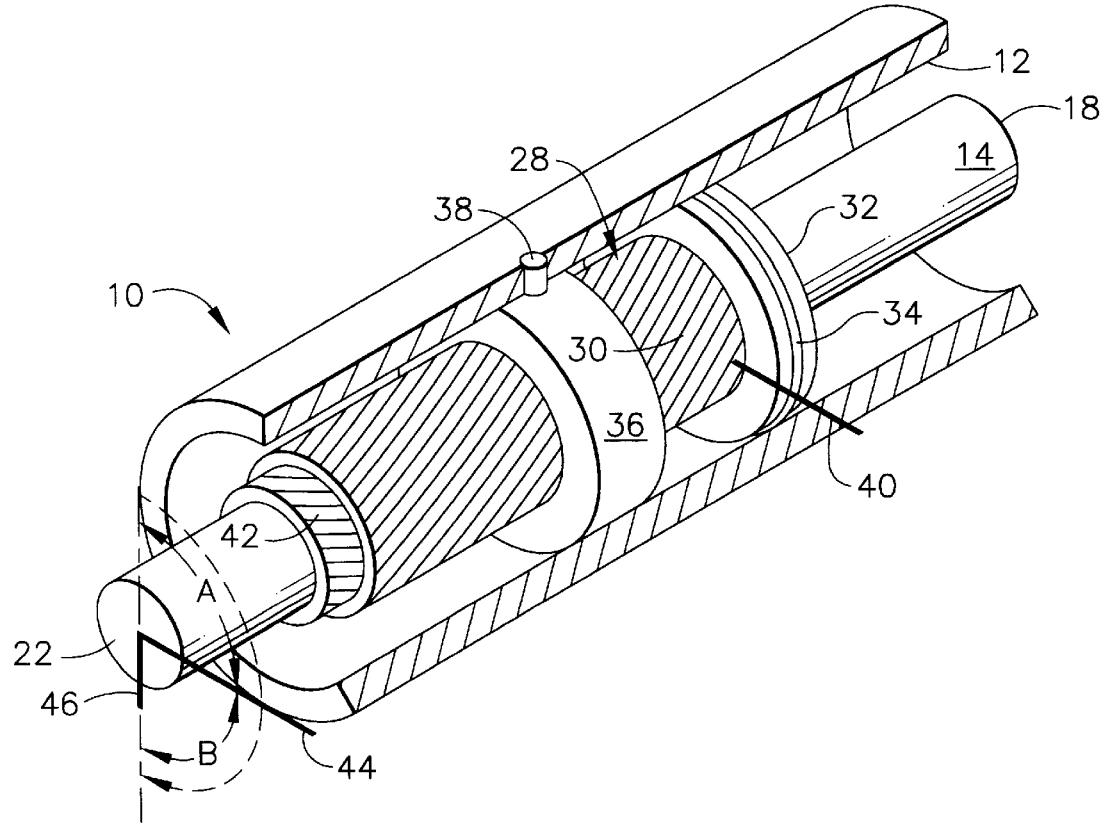

Referring to FIG. 1D, a main shaft first rotary locating point 44 illustrates the extent to which the main shaft is rotated by action of the collar alone, e.g., without any contribution from the main shaft helical splines 42 and the collar inside diameter splines, which is equal in magnitude to collar rotary locating point 40. A main shaft second rotary locating point 46 illustrates the final angular position of the main shaft due to the contribution by the main shaft helical splines 42 and the collar inside diameter splines. It is understood that the amount by which the main shaft is rotated within the cylinder per collar axial movement will vary depending on the particular application and operational constraints, e.g., available space. In an example embodiment, complete axial displacement of the collar and sealing sleeve within the cylinder provides a main shaft rotary displacement of approximately 180 degrees per 90 degree collar rotation.

An advantage of using two different sets of engaged helical splines to effect rotational movement, when compared to an actuator assembly comprising only a single set of engaged helical splines, is that low helix angles can be used. The use of low helix angles is advantageous because it enables smoother more efficient operation, i.e., it helps to avoid binding or high resistance movement, and enables the actuator assembly to be more compact in size.

As shown in FIG. 3, an actuating lever 47 is attached to end 22 of the main shaft 14. The actuating lever 47 is connected by suitable lever connection members, e.g., rigid lever linkage members or flexible lever linkage cable, to a movable member disposed within the turbocharger exhaust-gas turbine housing.

As discussed above, the axial displacement of the sealing sleeve 32 and collar 28 is effected by routing a desired pneumatic or hydraulic activating force pressure to the cylinder. In a preferred embodiment, the activating force is hydraulic force in the form of oil pressure. Referring to FIG. 2, oil passages 48 within the turbocharger housing 16 are used to route oil at a desired pressure to the actuator cylinder 12. In a preferred embodiment, the oil passage is positioned through the turbocharger housing to deliver pressurized oil within the cylinder between the bearing cap 20 and the sealing sleeve 32. The pressurized oil can be routed through the passage and to the cylinder by suitable fluid flow control device such as a solenoid valve or the like that can be activated by a conventional control means. In a preferred embodiment, the pressurized oil is routed to the cylinder by an electric solenoid valve 50 that is configured to deliver the pressurized oil in response to a particular control signal. In this particular embodiment, return sealing sleeve and collar axial displacement within the cylinder is effected by a biasing force that is imposed on the main shaft 14 by the movable member within the turbocharger turbine housing that is attached via the actuating lever 47. Thus, such return axial displacement is effected by activating the solenoid valve to discontinue its delivery of oil at the desired oil pressure to the cylinder 12.

The direct acting actuator assembly is used within a turbocharger used with internal combustion engines, comprising turbocharger components conventionally associated with turbochargers, to actuate a movable member such as a nozzle or vane within the turbocharger turbine housing. A feature of the direct acting actuator assembly is that the use of two sets of engaged helical spline sets provides a large degree of rotary actuation from a relatively short axial stroke, and provides efficient non-binding or reduced effort actuator operation. This improved actuation movement makes the actuator assembly both more responsive to the activating means, i.e., oil pressure, and enables packaging the actuator assembly in a compact size to optimize available space around the turbocharger and inside of an engine compartment.

Having now described the invention in detail as required by the patent statutes, those skilled in the art will recognize modifications and substitutions to the specific embodiments disclosed herein. Such modifications are within the scope and intent of the present invention.

What is claimed is:

1. A Turbocharger for internal combustion engines comprising:

a turbocharger housing;

an actuator assembly disposed within the housing for operating a movable member in the housing, the actuator assembly comprising:

an actuator cylinder disposed within the housing;

a main shaft positioned axially within the cylinder and rotatably mounted therein, the main shaft having a set of helical splines disposed along an outside diameter surface section, the main shaft having an end that extends through the cylinder and that is connected to an actuating lever;

a cylindrical collar disposed concentrically around a section of the main shaft and axially movable thereon, the collar including an annular seal disposed along an inside diameter to form a leak-tight seal between the collar and the main shaft, the collar having a set of helical splines disposed along an outside diameter surface, the collar having a set of helical splines disposed along an inside diameter surface that complements and engages the set of helical splines on the main shaft;

a sealing sleeve attached to the collar adjacent an end of the collar and having an outside diameter greater than the collar, the sealing sleeve including an annular seal disposed along an outside diameter to form a leak-tight seal between the sealing sleeve and a cylinder wall surface; and a stationary sleeve disposed concentrically around the collar and fixedly mounted within the cylinder a sufficient distance from the sealing sleeve to permit a desired degree of axial sealing sleeve and collar displacement within the cylinder, the stationary sleeve having a set of helical splines disposed along an inside diameter that complements and engages the collar outside diameter helical splines to rotate the collar within the cylinder as the collar is displaced axially therethrough, wherein rotation of the collar and stationary sleeve causes the main shaft to be rotated within the cylinder by engagement between the set of helical splines disposed along the collar inside diameter and the set of helical gears disposed along the main shaft, and wherein the engaged sets of helical splines disposed along the collar inside diameter and along the main shaft are designed to rotate the main shaft in the same direction as the collar and to an extent greater than the collar; means for activating the actuator assembly to provide axial and rotational movement.

* * * * *